US010286712B2

(12) United States Patent
Zhou et al.

(10) Patent No.: US 10,286,712 B2
(45) Date of Patent: May 14, 2019

(54) COATED PRINT MEDIA

(71) Applicant: Hewlett-Packard Development Company, L.P., Fort Collins, CO (US)

(72) Inventors: Xiaoqi Zhou, San Diego, CA (US); Xulong Fu, San Diego, CA (US); Tao Chen, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/764,753

(22) PCT Filed: Dec. 10, 2015

(86) PCT No.: PCT/US2015/064996
§ 371 (c)(1),
(2) Date: Mar. 29, 2018

(87) PCT Pub. No.: WO2017/099778
PCT Pub. Date: Jun. 15, 2017

(65) Prior Publication Data

US 2018/0354285 A1 Dec. 13, 2018

(51) Int. Cl.
*B41M 5/00* (2006.01)
*B41M 5/52* (2006.01)
(Continued)

(52) U.S. Cl.
CPC ..... *B41M 5/5218* (2013.01); *B05D 5/04* (2013.01); *B41J 2/01* (2013.01); *B41M 5/50* (2013.01);
(Continued)

(58) Field of Classification Search
CPC ..... B41M 5/50; B41M 5/5245; B41J 2/01; B05D 5/04
See application file for complete search history.

(56) References Cited

U.S. PATENT DOCUMENTS 5,753,077 A 5/1998 Horand et al.
5,952,091 A 9/1999 Horand et al.
(Continued)

FOREIGN PATENT DOCUMENTS

EP 2734380 5/2014
EP 2467263 9/2014
(Continued)

OTHER PUBLICATIONS

International Search Report dated Sep. 8, 2016 for PCT/US2015/064996, Applicant Hewlett-Packard Development Company, L.P.

*Primary Examiner* — Betelhem Shewareged
(74) *Attorney, Agent, or Firm* — Thorpe North & Western LLP

(57) ABSTRACT

A coated print medium can include a base stock having a basis weight of 35 gsm to 250 gsm, and a coating layer applied to the base stock at from 1 gsm to 50 gsm by dry weight. The base stock can include from 65 wt % to 95 wt % cellulose fiber with 20 wt % to 100 wt % being mechanical pulp, and from 5 wt % to 35 wt % inorganic pigment filler. The coating layer can include inorganic pigment particles having an average equivalent spherical diameter from 0.2 μm to 3.5 μm; a fixative agent including metal salt, cationic amine polymer, quaternary ammonium salt, quaternary phosphonium salt, or mixture thereof; and a polymer blend including water soluble polymer and water dispersible polymer having a Zeta potential greater than −40 mV, wherein a weight ratio water soluble polymer to water dispersible polymer is from 1:25 to 1:1.

20 Claims, 2 Drawing Sheets

(51) Int. Cl.

| | |
|---|---|
| ***B41M 5/50*** | (2006.01) |
| ***B05D 5/04*** | (2006.01) |
| ***B41J 2/01*** | (2006.01) |

(52) U.S. Cl.

CPC ..... *B41M 5/508* (2013.01); *B41M 5/52* (2013.01); *B41M 5/5227* (2013.01); *B41M 5/5245* (2013.01); *B41M 5/5254* (2013.01)

(56) References Cited

U.S. PATENT DOCUMENTS

| | | | | |
|---|---|---|---|---|
| 6,391,155 | B1 | 5/2002 | Wurster et al. | |
| 6,412,270 | B1 | 7/2002 | Mortzheim et al. | |
| 6,413,370 | B1 | 7/2002 | Wurster | |
| 6,918,662 | B2 | 7/2005 | Arita et al. | |
| 7,976,678 | B2 | 7/2011 | Dougherty et al. | |
| 8,247,045 | B2 | 8/2012 | Shaw-Klein et al. | |
| 8,425,728 | B2 | 4/2013 | Zhou et al. | |
| 8,580,159 | B2 | 11/2013 | Namba et al. | |
| 2004/0180184 | A1* | 9/2004 | Fillion | D21H 11/10 428/211.1 |
| 2007/0003716 | A1 | 1/2007 | Suzuki et al. | |
| 2009/0320708 | A1 | 12/2009 | Jackson et al. | |
| 2011/0104408 | A1 | 5/2011 | Wang et al. | |
| 2011/0104410 | A1 | 5/2011 | Toles et al. | |
| 2011/0244148 | A1 | 10/2011 | Zhou et al. | |
| 2012/0012264 | A1* | 1/2012 | Zhou | B41M 5/52 162/169 |
| 2012/0236095 | A1 | 9/2012 | Pal et al. | |
| 2013/0089683 | A1 | 4/2013 | Cormier et al. | |
| 2015/0050435 | A1 | 2/2015 | Pal et al. | |

FOREIGN PATENT DOCUMENTS

| | | |
|---|---|---|
| EP | 2173566 | 3/2015 |
| JP | H1112981 | 1/1999 |
| JP | 2003054110 | 2/2003 |
| JP | 2013163322 | 8/2013 |
| WO | 2010123505 | 10/2010 |
| WO | 2014114458 | 7/2014 |

* cited by examiner

COATED PRINT MEDIA

BACKGROUND

There are several reasons that inkjet printing has become a popular way of recording images on various media surfaces, particularly paper. Some of these reasons include low printer noise, variable content recording, capability of high speed recording, and multi-color recording. Additionally, these advantages can be obtained at a relatively low price to consumers. However, though there has been great improvement in inkjet printing, accompanying this improvement are increased demands in this area, e.g., higher speeds, higher resolution, full color image formation, increased stability, etc. Additionally, inkjet printing technology is becoming more prevalent in high speed commercial printing markets, competing with more laborious offset and gravure printing technologies. Coated media typically used for these more conventional types of printing, e.g., offset or gravure printing, can perform somewhat acceptably on high speed inkjet printing devices, but there is still room for improvement as it relates to image quality, ink bleed, edge roughness, and other similar properties.

BRIEF DESCRIPTION OF THE DRAWINGS

Additional features and advantages of the disclosure will be apparent from the detailed description which follows, taken in conjunction with the accompanying drawings, which together illustrate, by way of example, features of the present technology.

Figure 1:
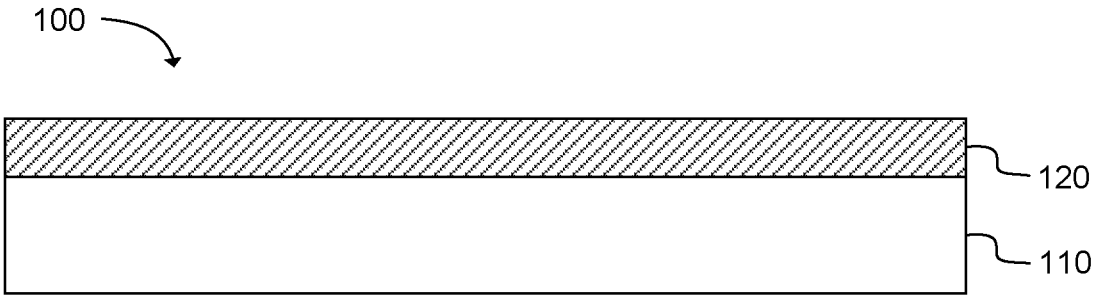
FIG. 1 shows a cross-sectional view of a coated media substrate in accordance with an example of the present technology.

Reference will now be made to several examples that are illustrated herein, and specific language will be used herein to describe the same. It will nevertheless be understood that no limitation of the scope of the disclosure is thereby intended.

DETAILED DESCRIPTION

High speed inkjet web printing is a printing technology developed during recent years, and typically is carried out using a continuous paper web at rates of hundreds of feet per minute. The paper web, which is a continuous roll of paper, is conveyed along a paper path that often includes stationary inkjet printheads for ejecting a series of ink droplets onto the web. When standard offset printing media are used in this new category of technology, the print media can be problematic. Poor image quality often results from ink bleed coupled with poor black optical density and poor color gamut. Other problems include "image strike through" when double-sided printing is used, which is caused by ink over-penetration though the print medium and/or poor media opacity. Furthermore, offset media typically is slow to dry, which limits the speed at which printing can be performed.

The present disclosure relates to print media that is particularly suitable for high speed, web press printing. For example, this print media can exhibit fast ink absorption while readily fixing colorant onto the media surface, resulting in high image quality and good durability, even when printed very fast under high speed conditions. Thus, the present disclosure is drawn to a coated print medium, a printing system which includes the coated print medium, and a method of preparing a coated print medium. The print medium can include a base stock having a basis weight of 35 gsm to 250 gsm, and a coating layer applied to the base stock at from 1 gsm to 50 gsm by dry coating composition. The base stock can include from 65 wt % to 95 wt % cellulose fiber with from 20 wt % to 100 wt % of the cellulose fiber in the form of a mechanical pulp (thus less than 80 wt % of the cellulose fiber is a chemical pulp), and from 5 wt % to 35 wt % inorganic pigment filler. Mechanical pulp is different from chemical pulp because chemical pulp dissolves out the lignin which binds the cellulose fiber together. Mechanical pulp has certain properties that make it useful in many paper grades. These properties are related to the fact that almost all the components of wood are retained in the mechanical pulp. Examples of the mechanical pulps are thermo-mechanical pulp, chemi-mechnical pulp, chemithermomechnical pulp, or thermomechnical chemi-pulp. The coating layer can include inorganic pigment particles having an average equivalent spherical diameter from 0.2 μm to 3.5 μm, and a fixative agent including a metal salt, a cationic amine polymer, a quaternary ammonium salt, a quaternary phosphonium salt, or mixture thereof. The coating layer can also include a polymer blend including a water soluble polymer and a water dispersible polymer having a Zeta potential from −40 mV to 0 mV, wherein a weight ratio water soluble polymer to water dispersible polymer is from 1:25 to 1:1.

In another example, a printing system can include an inkjet ink and the coated print medium described above and elsewhere herein. In accordance with examples herein, the inkjet ink can be particularly suited for printing on the coated print medium with good optical density, color gamut, reduced edge roughness, and general acceptable image quality. In one example, the inkjet ink can be a pigment-based inkjet ink that is suitable for interacting with a fixative agent that may be present in the coating layer of the coated print medium.

In another example, a method of preparing a coated print medium can include applying a coating composition to a base stock having a basis weight of 35 gsm to 250 gsm, and drying the coating composition on the base stock to leave a 1 gsm to 50 gsm coating layer by dry weight. The base stock can include from 65 wt % to 95 wt % cellulose fiber with 20 wt % to 100 wt % of the cellulose fiber being a mechanical pulp, and from 5 wt % to 35 wt % inorganic pigment filler. The coating composition can include water (which is essentially removed during drying), inorganic pigment particles, such as calcium carbonate particles other pigment particles, having an average equivalent spherical diameter from 0.2 μm to 3.5 μm; and a fixative agent including a metal salt, a cationic amine polymer, a quaternary ammonium salt, a quaternary phosphonium salt, or mixture thereof. The coating composition can further include a polymer blend including a water soluble polymer and a water dispersible polymer having a Zeta potential from −40 mV to 0 mV, wherein a weight ratio water soluble polymer to water dispersible polymer is from 1:25 to 1:1.

In these examples, it is noted that when discussing the coated print medium, the system, and the method of preparing the coated print medium, each of these discussions can be considered applicable to each of these examples, whether or not they are explicitly discussed in the context of that example. Thus, for example, in discussing details about the coated print medium per se, such discussion also refers to the systems and methods described herein, and vice versa.

As mentioned, the present technology relates to coated media for inkjet application, but is also useful as it relates to the demands of web press applications with high speed print rates, e.g., using the HP T200 Web Press or HP T300 Web Press at rates of 100 feet per minute or more. Printing applications which benefit from high grade printing media, such as magazines, catalogs, books, manuals, direct mails, labels, or other similar print jobs, where large volumes of high quality imagery is printed very quickly, are particularly advantaged by the present technology.

With specific reference to the base stock, this media substrate can be a cellulose base stock made from cellulose fiber pulp. In this example, the cellulose fiber pulp portion per se includes from 20 wt % to 100 wt % mechanical pulp, with less than 80 wt % chemical pulp being present as a maximum. In another example, the fiber pulp can include from 30 wt % to 100 wt % mechanical pulp, from 50 wt % to 100 wt % mechanical pulp, from 75 wt % to 100 wt % mechanical pulp, from 90 wt % to 100 wt % mechanical pulp, or 100 wt % mechanical pulp. One benefit of papers containing mechanical pulp is good opacity, even at low basis weight. The other advantages can include lower cost compared to chemical pulp. Chemical pulp can be present in some examples, and for example, can be used with the mechanical pulp with coating layers that may not have as much covering power as other thicker coatings, or in examples where slightly discolored (non-white) media is not paramount. By using some chemical pulp, less yellowing of the base stock may be present, and a whiter and more optically bright coated print medium can be prepared that lasts for a more extended period of time, even with the use thinner and/or less expensive coatings. That being said, as mentioned, for certain paper project, yellowing or grayer base stock media is not a problem, and other considerations such as cost reduction, etc., are desired. For example, high volume print jobs, such as those similar to "newsprint" type publication jobs where the life cycle of the printed products is limited, could benefit from this type of print media. In one example, because of the 20 wt % to 100 wt % mechanical pulp present, typically the base stock has an ISO brightness less than 85%, and typically from 65% to 80%, for example.

In addition to the fiber pulp, as mentioned, there is also an inorganic pigment filler that is present in the base stock. Examples of inorganic pigment filler include precipitated calcium carbonate, ground calcium carbonate, clay, titanium dioxide, or combination thereof. In one example, the inorganic filler is precipitated calcium carbonate or ground calcium carbonate. In another example, calcium carbonate filler can be present with titanium dioxide as a secondary inorganic filler, e.g., 1 wt % to 10 wt % titanium dioxide and about 5 wt % to 34 wt % of the calcium carbonate of the base paper stock as a whole. In one example, the base stock can be devoid of clay. In further detail, one example, the smoothness of the base stock can be up to 6 μm based on the PPS (Parker Print Surf) test.

Turning now to the coating layer, as mentioned, the application thickness, by dry weight, can range from 1 gsm to 50 gsm. In more specific detail, and to provide some alternative ranges, for some applications like advertising materials, books, annual reports, magazines, direct mailings, and high quality catalogs, coating weights from 5 gsm to 30 gsm per side can be used, and in more specific detail, from 8 gsm to 15 gsm per side may be used. For some application such as books, directories, timetables, brochures, lower coat weights may be used, such as those ranging from 1 gsm to 20 gsm per side, and often from 3 gsm to 14 gsm per side. For some special applications like art papers where higher thickness may be beneficial, the coat weight can be 20 to 50 gsm per side. These are merely examples. Furthermore, these coatings can be applied as a single layer coating, or by using double or triple coating processes, particularly for thicker coatings. These ranges are provided by example only and are thus not necessarily tied to the application mentioned therewith.

As mentioned, the surface coating composition can include inorganic pigment, a fixative agent, and a polymer blend. Regarding the inorganic pigment particles, calcium carbonate particles can be used, such as ground calcium carbonate (GCC) or precipitated calcium carbonate (PCC). For example, GCC 60 is suitable for use, which has an average particle diameter (d50) of 1.5 μm. On the other hand, PCC or aragonite PCC can be in the form of needle-like structure on a microscopic scale, i.e., they have a high aspect (length-to-width) ratio of greater than 25:1. This structure results in a loose coating layer packing with a relatively large fraction of voids on the coating surface.

The calcium carbonate particles can alternatively be in the form of calcium carbonate reacted with colloidal silica, titanium dioxide inter-calcined into calcium carbonate, silicon dioxide inter-calcined into calcium carbonate, aluminum trihydroxide inter-calcined into calcium carbonate, zirconium oxide inter-calcined into calcium carbonate, or aragonite precipitated calcium carbonate. Alternatively, GCC or PCC can be combined together, or either (or both) can be combined with one or more of these calcium carbonate reacted or inter-calcined composite compounds. In either case, the calcium carbonate particulates generally can be included in the coating composition at from 40 wt % to 99 wt % (based on dry coating layer components), from 40 wt % to 95 wt %, or from 60 wt % to 90 wt %.

In addition to the calcium carbonate particles, or alternatively, in some specific examples, other inorganic pigment particles can be dispersed in the coating layer, i.e. in addition to the calcium carbonate particles or instead of the calcium carbonate particles. To be clear, in one example, there are calcium carbonate particles present, and in another example, there is a mixture of calcium carbonate particles with a second co-dispersed inorganic pigment particle. However, it is also noted that other inorganic pigment particles can likewise be used instead of the calcium carbonate particles. For example, inorganic pigment particles having a platelet-like morphology or structure can be used with our without the calcium carbonate particles, and these particles can assist in providing "covering" power of the underlying base stock. Thus, the calcium carbonate particles (and/or any additional inorganic pigment particles that may be present) can cover the fibers on the surface of base paper stock and to smooth out the media surface. This covering function acts to reduce the non-uniformity in the surface roughness of the base stock, and further act to increase the opacity, brightness, whiteness, glossiness, and/or surface smoothness of the coated print media. In one example, a pigment with a platelet-like structure that can be used is aluminum silicate. Aluminum silicate has a median ESD (equivalent spherical diameter) of about 0.9 micron to about 1.6 microns. With this particular inorganic pigment particle type, in one example, not more than 5 percent by weight has an ESD greater than 4.5 microns, and not more than 10 percent of the particles have an ESD smaller than 0.3 microns. A higher percentage of small ESD particles tend to reduce covering effect. The aspect ratio of these pigment particles, the ratio of the ESD to their average thickness, for example, can range from about 10 to about 50.

Still other inorganic pigment particles that can be used pigments which can generate micro-porous structure to improved ink absorbing. Examples include fumed silica and silica gels, as well as certain structured pigments. Structured pigments include those particles which have been prepared specifically to create a micro-porous structure. Examples of these structured pigments include calcine clays or porous clays that are reaction products of clay with colloidal silica. Other inorganic particles such as particles of titanium dioxide ($TiO_2$), silicon dioxide ($SiO_2$), aluminum trihydroxide (ATH), calcium carbonate ($CaCO_3$), or zirconium oxide ($ZrO_2$) can be present, or these compounds can be present in forms that are inter-calcined into the structured clay. In one example, the inorganic pigment particles may be substantially non-porous mineral particles that have a special morphology that can produce a porous coating structure when solidified into a coating layer.

In the coating composition or coating layer, the inorganic pigment particles can be present, by dry weight in both cases, at from 40 wt % to 99 wt %, from 50 wt % to 95 wt %, or from 60 wt % to 95 wt %.

Notably, there is some overlap in material choice between the inorganic pigment fillers described for use in the base stock, and the inorganic pigment particles described for use in the coating composition. Thus, to avoid confusion, the term "filler" is used to describe the inorganic pigment used in the base stock and the term "particle" is used to describe the inorganic pigment used in the coating composition or layer.

The coating layer or composition can also include a fixative that can chemically, physically, and/or electrostatically bind a marking material, such as an inkjet ink, at or near an outer surface of the coated print medium to provide acceptable water-fastness, smear-fastness, and overall image stability. Another function of the fixatives is to reduce ink dry time. Examples of fixatives are metal salts, a cationic amine polymers, a quaternary ammonium salts, or a quaternary phosphonium salts. The metallic salt may be a water-soluble mono- or multi-valent metallic salt. The metallic salt may include cations, such as Group I metals, Group II metals, Group III metals, or transition metals, e.g., sodium, calcium, copper, nickel, magnesium, zinc, barium, iron, aluminum, or chromium ions. An anion species can be chloride, iodide, bromide, nitrate, sulfate, sulfite, phosphate, chlorate, acetate ions, or various combinations. Any one of these fixatives can be used, but in some examples, combinations of fixatives can be used, such as a metal salt admixed with the cationic amine polymer or one of the quaternary salts. The fixative agent can be present at from 1 wt % to 20 wt % in the coating layer (based on dry weight or solids of the coating composition), for example.

As mentioned, the coating layer also includes a polymer blend, which is a mixture of two or more polymeric compounds. One polymeric compound is a water dispersible polymer and the other is a water soluble polymer. The water dispersible polymer can included polymeric latex or polymeric emulsion where the polymeric core surrounded by surfactant with mid to large weight average molecular weight, e.g., from 80,000 to 1,500,000 Mw. The polymeric core can be dispersed by a continuous liquid phase to form a emulsion-like composition. Examples of water-dispersible polymers include, but are not limited to, acrylic polymers or copolymers latex, vinyl acetate latex, polyesters latex, vinylidene chloride latex, styrene-butadiene latex, acrylonitrile-butadiene copolymers latex, styrene acrylic copolymer latexes, and/or the like. As mentioned, the water dispersible polymer can be a latex polymer such as acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In another example, the water dispersible polymer can include a vinyl acetate-based polymer, an acrylic polymer, a styrene polymer, a styrene-butadiene (SBR)-based polymer, a polyester-based polymer, a vinyl chloride-based polymer, an acid-based polymer, or the like. In one aspect, the water dispersible particle can be a polymer or a copolymer including acrylic polymers, vinyl-acrylic copolymers and acrylic-polyurethane copolymers. In another aspect, the latex particle can be cationic acrylate latex. In one specific aspect, the latex can be a vinyl acetate polymer.

Generally, the water dispersible polymer can include particles having a weight average molecular weight ($M_w$) of 5,000 to 500,000. In one example, the water dispersible polymer can range from 50,000 $M_w$ to 300,000 $M_w$. In some examples, the average particle diameter can be from 10 nm to 5 μm and, as other examples, from 10 to 500 nm, and in yet other examples, from 50 nm to 250 nm. The particle size distribution of the water dispersible polymer is not particularly limited, and either polymer having a broad particle size distribution or latex having a mono-dispersed particle size distribution may be used. It is also possible to use two or more kinds of polymer fine particles each having a mono-dispersed particle size distribution in combination.

On the other hand, the water soluble polymer can be a macromolecule having hydrophilic functional groups, such as —OH, —COOH, —COC. Examples of the water soluble polymers include, but are not limited to, polyvinyl alcohol, starch derivatives, gelatin, cellulose and cellulose derivatives, polyethylene oxide, polyvinyl pyrrolidone, or acrylamide polymers. By "water soluble," it is noted that the polymer can be at least partially water soluble, mostly water soluble (at least 50%), or in some examples, completely water soluble (at least 99%).

The water soluble polymer and water dispersible polymer are included in the coating layer at a dry weight ratio of 1:25 to 1:1. In certain example, there is more water dispersible polymer than water soluble polymer by dry weight. Examples thus include water soluble polymer to water dispersible polymer weight ratios ranging from 1:25 to 24:25, 1:10 to 24:25, 1:5 to 9:10, 2:5 to 4:5, or to 4:7 to 5:7. In either case, if the water soluble polymer is excessive, it can cause poor wet durability of the resulting print and excessive high viscosity of the coating composition mix used to form the coating layer. On the other hand, if the water dispersible polymer content is too high in the blend, this over-dosage can cause an interaction with the fixative agent and results in an unstable coating composition. Thus, to provide desirable coating stability and effectiveness in the resulting coating layer, a proper ratio between water soluble and water dispersible polymer is beneficial.

Furthermore, the electrokinetics of the water-dispersible polymer, when they are mixed with the inorganic pigment particles and fixative agent in the aqueous coating solution, relates also to performance-related properties of the coating composition, such as binding power and composition stability. The electrokinetic property is measured in terms of Zeta potential. The term "Zeta potential" as used herein refers to the potential difference between the dispersed particle and the stationary layer of fluid attached to the dispersed particle, and relates to surface charge and electrophoretic mobility. It has been recognized that the Zeta potential of water dispersible polymer used herein can be greater than −40 mV, and more typically. Such Zeta potentials have been found to produce an aqueous coating solution with desirable stability and rheology, as well as acceptable binding properties. If the Zeta potential is too low, the binder will adversely react with the metallic salt ink fixatives and produce gel. On the other hand, a binder with too high Zeta potential will cause precipitation of the inorganic pigment slurry. Thus, in one example, the Zeta potential can be from −40 mV to 0 mV.

Still further, the glass transition temperature ($T_g$) of the water dispersible polymer is another factor to consider. A desirable minimum film-forming temperature, for example, can be considered for a particular coating composition or coating layer. In one example, the $T_g$ of the water dispersible polymer can be from −30° C. to 50° C., from −30° C. to 30° C., or often in the range of −20° C. to 20° C.

The polymer blend (collectively as a whole based on all polymers) can be included in the coating composition or coating layer, by dry weight, at from 1 wt % to 25 wt %, from 2 wt % to 20 wt %, or from 5 wt % to 15 wt %. The weight ratios of the water soluble polymer to water dispersible polymer are provided above.

Figure 2:
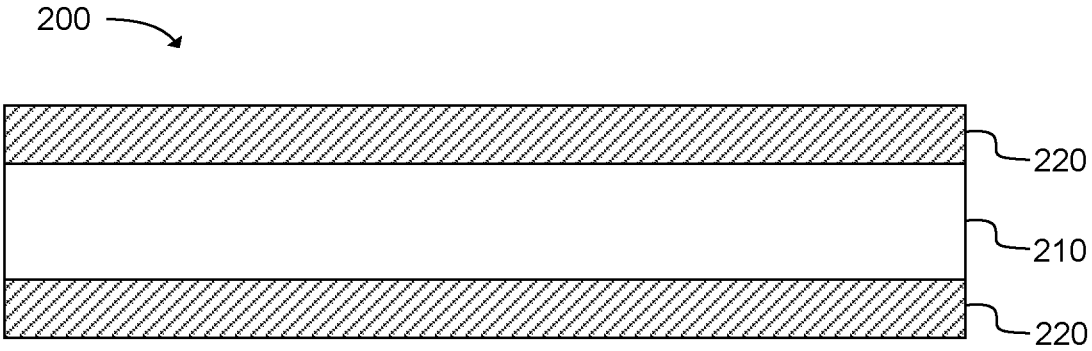
FIG. 2 shows a cross-sectional view of an alternative coated media substrate in accordance with an example of the present technology.

Turning now to the FIGS., FIGS. 1 and 2 provide a cross-sectional view of a coated media sheet or coated print medium prepared in accordance with examples of the present disclosure. In FIG. 1, a coated print medium is shown generally at 100. The coated print medium includes a base stock 110 as described herein, and a coating layer 120 as also describe herein. FIG. 2 shows a coated print medium 200 that is coated on both sides of a base stock 210. More specifically, each side of the base stock is coated with a coating layer 220. Since the coated print media of the present technology is particularly suitable for use with high speed inkjet web printing, e.g., roll to roll at rates of more than 100 feet per minute, the capability to absorb of an aqueous liquid in the inkjet ink assists in achieving desired image quality. The absorption capability is related in one sense to the porosity of the base stock and the coating layer, which is related to the coating composition used to apply the coating layer. Paper porosity can be measured based on total connecting air voids, both vertical and horizontal, that exist in a printing paper. Thus, porosity is an indication of absorptivity or the ability of the paper sheet to accept an inkjet ink. In one example, the coated print media porosity can be represented by measuring the air resistance of the papers using the method defined by the Technical Association of the Pulp and Paper Industry (TAPPI) as "Air Permeance of Paper (Sheffield Method)," Test Method T 547 om-07. This method can be used to measure the porosity of the coated print medium by forcing air through paper, measuring the rate of the air flow, and reporting results as Sheffield units. In accordance with the present disclosure, the coated print medium porosity can be achieved by adjusting the coating composition and/or the coating process. A coated print medium with a low volume of voids may indicate a poor porosity value leading to extended dry time and/or ink smearing or bleeding during printing. An excessively high void value, however, presents an overly porous structure, which may absorb the majority of the ink colorant into the base paper, thereby generating low optical density (fading) images. Thus, in one example, the porosity of the final, finished coated paper of the present disclosure, as represented by air permeance, can range, in one example, from 15 to 40 Sheffield units using on Parker Print-Surf tester.

The coating composition used to prepare the coating layer can be applied on base stock by a surface size press process, such as by the use of a puddle-size press, a film-size press, or the like. The puddle-size press can be configured as having horizontal, vertical, and inclined rollers. The film-size press may include a metering system, such as gate-roll metering, blade metering, Meyer rod metering, or slot metering, for example. For some examples, a film-size press with short-dwell blade metering may be used as an application head to apply coating solution. For coated print media with a thicker coating, an off-line coater can be used, or multiple coatings can be applied to accrue the desired thickness. Some other non-limitative examples of suitable deposition techniques/manufacturing processes include roll-coating, conventional slot-die processing, blade coating, bent blade coating, rod coating, shear roll coating, slot-die cascade coating, pond coating, curtain coating and/or other comparable methods including those that use circulating and non-circulating coating technologies. In certain instances, spray-coating, immersion-coating, and/or cast-coating techniques may be suitable for depositing.

In another example, as mentioned, a coating composition can be used to apply the coating layer on the base stock in accordance with examples of the present disclosure. It is noted that when discussing the coating layer, it is understood that a coating composition with water (and option other volatiles) is used to carry the solids that will remain with the coating layer once the water and other components that may be present dry and are primarily removed from the coating layer. Some residual moisture may remain, but it is understood that most of the water, for example, will be removed though a drying process. Thus, any discussion herein with respect to the coating layer is relevant to the coating composition and should be considered as supporting examples where the coating composition described. For example, weight concentrations are used herein in terms of dry weight, these numbers are also relevant to the coating composition per se.

Figure 3:
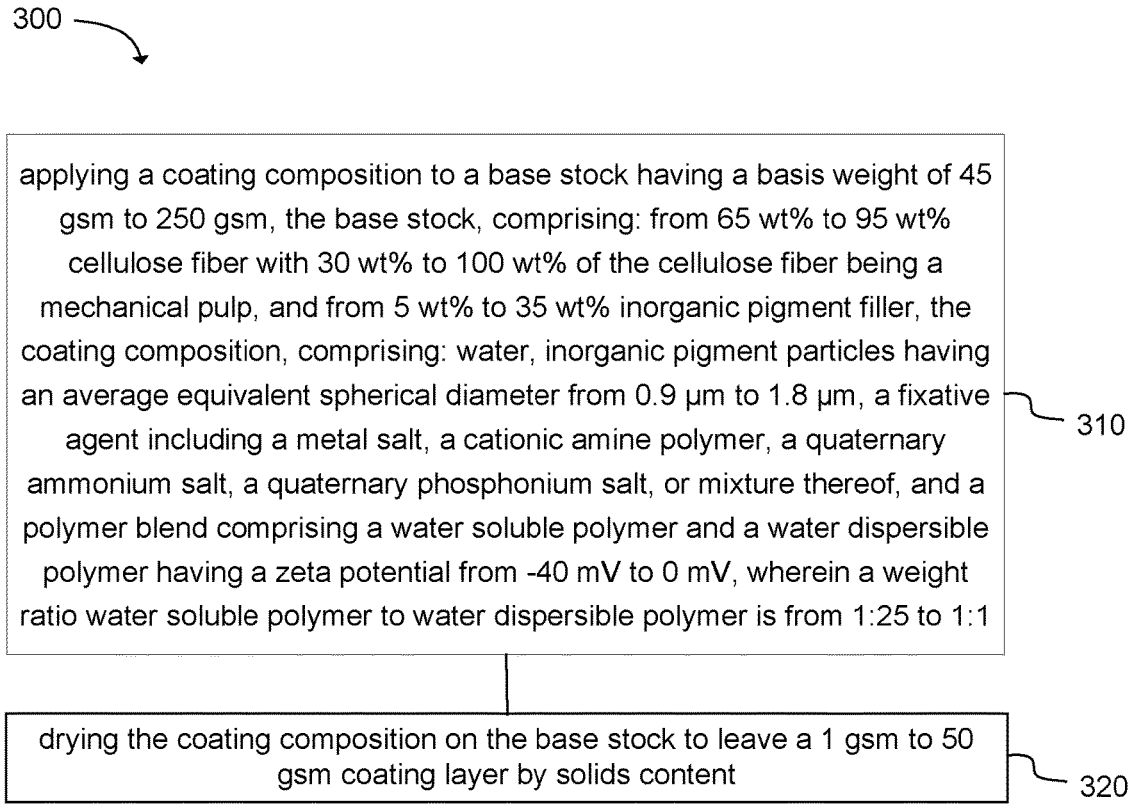
FIG. 3 shows a flow chart of a method of preparing a coated media substrate in accordance with an example of the present technology.

In accordance with this, turning now to FIG. 3, a method of preparing a coated print medium 300 can include steps of applying 310 a coating composition to a base stock having a basis weight of 35 gsm to 250 gsm, and drying 320 the coating composition on the base stock to leave a 1 gsm to 50 gsm coating layer by dry weight. The base stock can include from 65 wt % to 95 wt % cellulose fiber with 20 wt % to 100 wt % of the cellulose fiber being a mechanical pulp, and from 5 wt % to 35 wt % inorganic pigment filler. The coating composition (used to form the layer) can include water; calcium carbonate particles having an average equivalent spherical diameter from 0.2 μm to 3.5 μm; a fixative agent including a metal salt, a cationic amine polymer, a quaternary ammonium salt, a quaternary phosphonium salt, or mixture thereof; and a polymer blend including a water soluble polymer and a water dispersible polymer having a Zeta potential greater than −40 mV, wherein a dry weight ratio water soluble polymer to water dispersible polymer is from 1:25 to 1:1. In one specific example, the coated print medium can be calendered under heat and pressure ranging from 500 psi to 2500 psi at from room temperature to 250° C. Any types of calendering device, such as a super calender, soft nip calender or hard nip calender, can be used to calender coat samples to a desired smoothness. Parameters for controlling smoothness and/or gloss can be by controlling nips, pressure, temperature, and/or speed.

Figure 4:
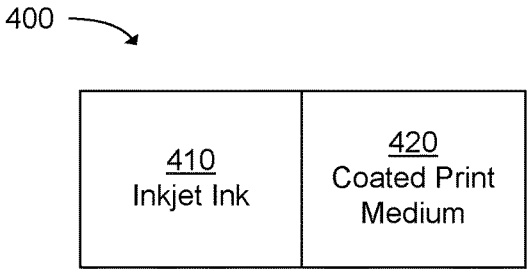
FIG. 4 shows a print system in accordance with an example of the present technology.

The coated print media of the present disclosure can be paired with inkjet inks in inkjet printing systems. For example, FIG. 4 depicts such a system 400 where an inkjet ink 410 is paired with a coated print medium 420 of the present disclosure. The inkjet ink can be a water-based ink such as a water-based inkjet ink. Inkjet inks generally include a colorant dispersed or dissolved in an ink vehicle. As used herein, "liquid vehicle" or "ink vehicle" refers to the liquid fluid in which a colorant is placed to form an ink. Ink vehicles can include a wide variety of compounds, such as water surfactants, solvents, co-solvents, anti-kogation agents, buffers, biocides, sequestering agents, viscosity modifiers, surface-active agents, etc. Though not part of the liquid vehicle per se, in addition to the colorants, the liquid vehicle can carry solid additives such as polymers, latexes, UV curable materials, plasticizers, etc.

Generally the colorant discussed herein can include a pigment and/or dye. As used herein, "dye(s)" refer to compounds or molecules that are typically water soluble and that impart color to an ink vehicle. As used herein, "pigment (s)" when specifically discussed in the context of colorant can be color-imparting particles that are dispersed by small molecules, oligomers, or polymers attached thereto (self-dispersed), or which are co-dispersed therewith (separate dispersant that associates with the surface of the pigment).

Typical ink vehicle formulations can include water, and can further include co-solvents present in total at from 0.1 wt % to 40 wt %, depending on the jetting architecture, though amounts outside of this range can also be used. Further, non-ionic, cationic, and/or anionic surfactants can be present, ranging from 0.01 wt % to 10 wt %. In addition to the colorant, the balance of the formulation can be purified water and other optional additives, such as viscosity modifiers, biocides, buffers, etc., and furthermore, the inkjet ink can optionally include other solids such as latex particles.

It is noted that, as used in this specification and the appended claims, the singular forms "a," "an," and "the" include plural referents unless the content clearly dictates otherwise.

When referring to "high speed" as it related to a digital printing press, presses such as the HP T200 Web Press or the HP T300 Web Press exhibit printing speeds that are commensurate of what is considered to be "high speed." For example, the HP T300 Web Press can print on media at a rate of 400 feet per minute. This capability would be considered high speed. In another example, and more generally, printing at 100 feet per minute would also be considered high speed.

The "Parker Print Surf" test or "PPS" test refers to a roughness tester that replicates the conditions of various types of printing, e.g., offset, gravure, and letterpress printing processes, where the operator can select 0.5 mPa, 1.0 mPa or 2.0 mPa loading. Thus, the paper can be tested under the same compression loads found in a printing process. In accordance with examples of the present disclosure, 1.0 mPa loading is used for the values provided herein.

The term "ISO brightness" per the ISO2470 method refers to the European standard that quantifies the brightness of paper as it would be perceived in an environment that is illuminated with a mixture of cool-white fluorescence and some unfiltered daylight, i.e. C/2°.

The "equivalent spherical diameter" or "ESD" of an irregularly-shaped particle is defined herein as the diameter of a sphere that is equivalent to the volume of the irregularly shaped particle.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt. % to about 20 wt. % should be interpreted to include not only the explicitly recited limits of 1 wt. % and about 20 wt. %, but also to include individual weights such as 2 wt. %, 11 wt. %, 14 wt. %, and sub-ranges such as 10 wt. % to 20 wt. %, 5 wt. % to 15 wt. %, etc.

EXAMPLES

The following examples illustrate some of the coating compositions and resulting coating layers of the present disclosure that are presently known. However, it is to be understood that the following are only exemplary or illustrative of the application of the principles of the present compositions, systems, and methods. Numerous modifications and alternative compositions, systems, and methods may be devised without departing from the spirit and scope of the present disclosure. The appended claims are intended to cover such modifications and arrangements. Thus, while the examples have been described above with particularity, the following provide further detail in connection with what are presently deemed to be the acceptable examples.

Example 1

Six coating compositions were prepared that are suitable for application to a base stock media in accordance with examples of the present disclosure. Each of these compositions was evaluated initially for Coating Mix Stability as it related to Zeta potential (ZP) of the water dispersible polymer component. The six coating compositions were prepared and the data related to Coating Mix Stability can be found in Table 1 below. Additionally, each of these coating compositions was prepared and applied at 8 gsm (based on dry weight) to a base stock prepared in accordance with examples of the present disclosure, i.e. basis weight of 35 gsm to 250 gsm, from 65 wt % to 95 wt % cellulose fiber with from 20 wt % to 100 wt % of the cellulose fiber being a mechanical pulp, and from 5 wt % to 35 wt % inorganic pigment filler. Each sample was printed with an HP CM8060 MFP Edgeline printer from Hewlett-Packard Co., Palo AltoH, Calif., using HP A50 pigment inks. The printing process involved 2 passes and six dry spins to mimic high-speed, digital WebPress inkjet printing. The Wet Durability was determined and the values are provided also in Table 1 below.

TABLE 1

| Formulation (Ingredients in parts by weight) | 1 | 2 | 3 | 4 | 5 | 6 |
|---|---|---|---|---|---|---|
| Hydrocarb ® 60 (Ground Calcium Carbonate from Omya, Inc.) | 100 | 100 | 100 | 100 | 100 | 100 |
| Mowiol ® 4-98 (Polyvinyl Alcohol from Sigma Aldrich) | 4.5 | 4.5 | 4.5 | 4.5 | 4.5 | 4.5 |
| PX9550 (Carboxylated Styrene Butadiene Latex from Synthomer; ZP = −52) | 7 | — | — | — | — | — |
| Styrolnol ® D915 (Carboxylated Styrene Butadiene Latex from BASF; ZP = −50) | — | 7 | — | — | — | — |
| Gencryl ® 9525 (Styrene/Butadiene Latex from RohmNova; ZP = −54) | — | — | 7 | — | — | — |
| Sancure ® 2026 (Polyurethane Latex from Sanncore Industries, Inc.; ZP = −53) | — | — | — | 7 | — | — |
| Lucidene ® 645 (Acrylic/Urethane Latex from Dow Chemical; ZP = −0.1) | — | — | — | — | 7 | — |
| PX9740 (Carboxylated Styrene Butadiene Latex from Synthomer; ZP = −33.5) | — | — | — | — | — | 7 |
| $CaCl_2$ | 4 | 4 | 4 | 4 | 4 | 4 |
| Tinnopal ® ABP (Optical Brightener from Florham) | 0.25 | 0.25 | 0.25 | 0.25 | 0.25 | 0.25 |
| Coating Mix Stability (1 = Worst; 5 = Best) | 2* | 2* | 2* | 2* | 5 | 5 |
| [1]Wet Durability (1 = Worst; 5 = Best) | 2.5 | 2 | 2.5 | 2 | 4 | 3.5 |

*Gelled After Addition of $CaCl_2$ salt.

[1]Wet Durability is determined by evaluating degradation upon rubbing and smearing a printed image using a water-moisturized soaked paper pad on a rubber eraser. The eraser is mounted on a force sprint to provide a consistent reproducible pressure as the paper pad is rubbed single time across the printed image, followed by removal of the tool and visual evaluation.

As can be seen in Table 1 above, the water dispersible polymers having a Zeta Potential between −40 mV and 0 mV exhibited the best Coating Mix Stability and Wet Durability scores.

Example 2

Three coating compositions were prepared that are suitable for application to a base stock media in accordance with examples of the present disclosure. Each of these compositions was evaluated initially for Dry Durability and Wet Durability. The three coating compositions were prepared and applied at 8 gsm (based on dry weight) to a base stock prepared in accordance with examples of the present disclosure, i.e. basis weight of 35 gsm to 250 gsm, from 65 wt % to 95 wt % cellulose fiber with from 20 wt % to 100 wt % of the cellulose fiber being a mechanical pulp, and from 5 wt % to 35 wt % inorganic pigment filler. Each sample was printed with an HP CM8060 MFP Edgeline printer from Hewlett-Packard Co., Palo Alto, Calif., using HP A50 pigment inks. The printing process involved 2 passes and six dry spins to mimic high-speed, digital WebPress inkjet printing. The Wet Durability was determined and the values are provided also in Table 2 below.

TABLE 2

| | Formulation (Ingredients in parts by weight) | | |
|---|---|---|---|
| | 6 | 7 | 8 |
| Hydrocarb ® 60 (Ground Calcium Carbonate from Omya, Inc.) | 100 | 100 | 100 |
| Mowiol ® 4-98 (Polyvinyl Alcohol from Sigma Aldrich) | 4.5 | 11.5 | — |
| PX9740 (Carboxylated Styrene Butadiene Latex from Synthomer ZP = −33.5) | 7 | — | 11.5 |
| $CaCl_2$ | 4 | 4 | 4 |
| Tinnopal ABP (Optical Brightener from Florham) | 0.25 | 0.25 | 0.25 |
| [1]Wet Durability (1 = Worst; 5 = Best) | 3.5 | 2 | 3.5 |
| [2]Dry Durability (1 = Worst; 5 = Best) | 4 | 4.5 | 2.5 |

[1]Wet Durability is determined by evaluating degradation upon rubbing and smearing a printed image using a water-moisturized soaked paper pad on a rubber eraser. The eraser is mounted on a force sprint to provide a consistent reproducible pressure as the paper pad is rubbed single time across the printed image, followed by removal of the tool and visual evaluation.

[2]Dry Durability is determined similarly with respect to Wet Durability, except a dry device is drawn across the printed page after the print is dry.

As can be seen in Table 2 above, the absence of the water dispersible polymer (and replacing it with additional water soluble polymer) provided poor wet durability, while the absence of the water soluble polymer (and replacing it with additional water dispersible polymer) provided poor dry durability. A combination of both polymers provided acceptable results with both wet durability and dry durability performance.

While the disclosure has been described with reference to certain examples, various modifications, changes, omissions, and substitutions can be made without departing from the spirit of the disclosure. It is intended, therefore, that the disclosure be limited only by the scope of the following claims.

What is claimed is:

1. A coated print medium, comprising:

a base stock having a basis weight of 35 gsm to 250 gsm, comprising:

from 65 wt % to 95 wt % cellulose fiber, wherein from 20 wt % to 100 wt % of the cellulose fiber is mechanical pulp, and from 5 wt % to 35 wt % inorganic pigment filler, a coating layer applied to the base stock at from 1 gsm to 50 gsm by dry weight, the coating layer, comprising:

inorganic pigment particles having an average equivalent spherical diameter from 0.2 μm to 3.5 μm, a fixative agent including a metal salt, a cationic amine polymer, a quaternary ammonium salt, a quaternary phosphonium salt, or mixture thereof, and a polymer blend comprising a water soluble polymer and a water dispersible polymer having a Zeta potential greater than −40 mV, wherein a dry weight ratio water soluble polymer to water dispersible polymer is from 1:25 to 1:1.

2. The coated print medium of claim 1, wherein the inorganic pigment filler in the base stock comprises precipitated calcium carbonate, ground calcium carbonate, clay, titanium dioxide, or combination thereof.

3. The coated print medium of claim 1, wherein the base stock has an ISO brightness up to 85% and a PPS smoothness of 6 microns or less.

4. The coated print medium of claim 1, wherein the base stock has an ISO brightness from 65% to 80%, and wherein from 30 wt % to 100 wt % of the cellulose fiber is mechanical pulp.

5. The coated print medium of claim 1, wherein the inorganic pigment particles comprise calcium carbonate particles, said calcium carbonate particles in the form of ground calcium carbonate particles, precipitated calcium carbonate particles, calcium carbonate reacted with colloidal silica, titanium dioxide inter-calcined into calcium carbonate, silicon dioxide inter-calcined into calcium carbonate, aluminum trihydroxide inter-calcined into calcium carbonate, zirconium oxide inter-calcined into calcium carbonate, aragonite precipitated calcium carbonate, or mixtures thereof.

6. The coated print medium of claim 1, wherein the inorganic pigment particles comprise fumed silica, silica gel, calcine clay, porous clay reacted with colloidal silica, titanium dioxide, silicon dioxide, aluminum trihydroxide, zirconium oxide, titanium dioxide inter-calcined into clay, silicon dioxide inter-calcined into clay, aluminum trihydroxide inter-calcined into clay, zirconium oxide inter-calcined into clay, or mixtures thereof.

7. The coated print medium of claim 1, wherein the inorganic pigment particles comprise aluminum silicate having an average equivalent spherical diameter from 0.9 μm to 1.6 μm, with no more than 5 wt % greater than 4.5 μm and more than 10 wt % less than 0.3 μm, and wherein the aluminum silicate has a plate-like structure having an average equivalent spherical diameter to average thickness ratio from 10:1 to 50:1, where the thickness is measured at the shortest distance across the plate-like structure.

8. The coated print medium of claim 1, wherein the weight ratio water soluble polymer to water dispersible polymer is from 1:5 to 9:10.

9. The coated print medium of claim 1, wherein the water dispersible polymer has a glass transition temperature from −30° C. to 50° C.

10. The coated print medium of claim 1, wherein the coated print medium has a porosity measured in air permeance at from 15 to 40 Sheffield units.

11. A printing system, comprising:

an inkjet ink; and the coated print medium of claim 1.

12. A method of preparing a coated print medium, comprising:

applying a coating composition to a base stock having a basis weight of 35 gsm to 250 gsm, the base stock, comprising:

from 65 wt % to 95 wt % cellulose fiber with 20 wt % to 100 wt % of the cellulose fiber being a mechanical pulp, and from 5 wt % to 35 wt % inorganic pigment filler, the coating composition, comprising:

water, inorganic pigment particles having an average equivalent spherical diameter from 0.2 μm to 3.5 μm, a fixative agent including a metal salt, a cationic amine polymer, a quaternary ammonium salt, a quaternary phosphonium salt, or mixture thereof, and a polymer blend comprising a water soluble polymer and a water dispersible polymer having a Zeta potential greater than −40 mV, wherein a weight ratio water soluble polymer to water dispersible polymer is from 1:25 to 1:1; and drying the coating composition on the base stock to leave a 1 gsm to 50 gsm coating layer by dry weight.

13. The method of claim 12, wherein the inorganic pigment filler in the base stock comprises precipitated calcium carbonate, ground calcium carbonate, clay, titanium dioxide, or combination thereof.

14. The method of claim 12, wherein the inorganic pigment particles comprise ground calcium carbonate particles, precipitated calcium carbonate particles, calcium carbonate reacted with colloidal silica, titanium dioxide inter-calcined into calcium carbonate, silicon dioxide inter-calcined into calcium carbonate, aluminum trihydroxide inter-calcined into calcium carbonate, zirconium oxide inter-calcined into calcium carbonate, aragonite precipitated calcium carbonate, fumed silica, silica gel, calcine clay, porous clay reacted with colloidal silica, titanium dioxide, silicon dioxide, aluminum trihydroxide, zirconium oxide, titanium dioxide inter-calcined into clay, silicon dioxide inter-calcined into clay, aluminum trihydroxide inter-calcined into clay, or zirconium oxide inter-calcined into clay, aluminum silicate, or mixtures thereof.

15. The method of claim 12, further comprising calendering the coating layer on the base stock at a pressure from 500 psi to 2500 psi and at a temperature from room temperature to 250° C.

16. The method of claim 12, wherein the base stock has an ISO brightness up to 85% and a PPS smoothness of 6 microns or less.

17. The method of claim 12, wherein the base stock has an ISO brightness from 65% to 80%, and wherein from 30 wt % to 100 wt % of the cellulose fiber is mechanical pulp.

18. The method of claim 12, wherein the inorganic pigment particles comprise aluminum silicate having an average equivalent spherical diameter from 0.9 μm to 1.6 μm, with no more than 5 wt % greater than 4.5 μm and more than 10 wt % less than 0.3 μm, and wherein the aluminum silicate has a plate-like structure having an average equivalent spherical diameter to average thickness ratio from 10:1 to 50:1, where the thickness is measured at the shortest distance across the plate-like structure.

19. The method of claim 12, wherein the weight ratio water soluble polymer to water dispersible polymer is from 1:5 to 9:10, and wherein the water dispersible polymer has a glass transition temperature from −30° C. to 50° C.

20. The printing system of claim 11, wherein the coated print medium has a porosity measured in air permeance at from 15 to 40 Sheffield units.

* * * * *